US007022761B2

(12) United States Patent
Crabtree et al.

(10) Patent No.: US 7,022,761 B2
(45) Date of Patent: Apr. 4, 2006

(54) PROCESS FOR PRINTING TEXTILE FABRICS

(75) Inventors: Alan John Crabtree, Bradford (GB); Martin Lane, Heckmondwike (GB)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 0 days.

(21) Appl. No.: 10/481,348

(22) PCT Filed: Jun. 13, 2002

(86) PCT No.: PCT/EP02/06510

§ 371 (c)(1),
(2), (4) Date: Dec. 17, 2003

(87) PCT Pub. No.: WO03/000980

PCT Pub. Date: Jan. 3, 2003

(65) Prior Publication Data

US 2004/0173115 A1 Sep. 9, 2004

(30) Foreign Application Priority Data

Jun. 22, 2001 (GB) ..... 0115240

(51) Int. Cl.
*C08G 18/80* (2006.01)

(52) U.S. Cl. ..... 524/591; 524/839; 428/423.1; 8/494; 8/552; 528/45

(58) Field of Classification Search ..... 524/591, 524/839; 428/423.1; 8/494, 552
See application file for complete search history.

(56) References Cited

U.S. PATENT DOCUMENTS

| | | | | |
|---|---|---|---|---|
| 3,867,171 | A * | 2/1975 | Ellsworth | 428/195.1 |
| 4,598,120 | A * | 7/1986 | Thoma et al. | 524/591 |
| 5,169,888 | A * | 12/1992 | Sales | 524/267 |
| 5,556,935 | A | 9/1996 | Träubel et al. | 528/99 |
| 5,607,482 | A | 3/1997 | Reiff et al. | 8/495 |
| 5,614,564 | A | 3/1997 | Hwang et al. | 521/84.1 |
| 6,080,830 | A | 6/2000 | Dirschl et al. | 528/45 |
| 6,096,822 | A | 8/2000 | Seven et al. | 524/513 |
| 6,776,804 | B1 * | 8/2004 | Crabtree et al. | 8/445 |
| 2003/0072952 | A1 | 4/2003 | Crabtree et al. | 428/447 |

FOREIGN PATENT DOCUMENTS

| | | |
|---|---|---|
| JP | 02-91280 | 3/1990 |
| WO | 99/16958 | 4/1999 |

OTHER PUBLICATIONS

Chain Extender Curatives and Cross Linkers, downloaded product list from the website of Brian Jones and Associates Ltd., pp. 1-3, Copyright © 2000.
2003 McCutcheon's, vol. 1: Emulsifiers & Detergents, North American Edition, p. 294, Copyright © 2003.

* cited by examiner

*Primary Examiner*—Rachel Gorr
(74) *Attorney, Agent, or Firm*—Kevin T. Mansfield

(57) ABSTRACT

A printing paste containing: a) 5 to 30% by weight of a polyurethane, b) 1 to 20% by weight of an organic fixing agent, c) 0 to 50% by weight of one or more further ingredient(s) and d) water as the remainder, the sum of the amounts of components (a)+(b)+(c)+(d) being 100%, is suitable for printing textile materials.

15 Claims, No Drawings

PROCESS FOR PRINTING TEXTILE FABRICS

Vast numbers of garments are produced every year.

The aesthetics of the garment are often enhanced by printing, for example, the manufacturer's logo or some other design onto the garment. This applies in particular to leisure wear, e.g. T-shirts. One of the principal features of leisure wear is comfort. This generally means that mostly very elastic, stretchable fabrics are used.

Printing T-shirts is an industry in its own right. With T-shirts, in particular, the design is generally printed onto the garment after it has been made up into a garment.

As with other clothing, the printed design has to be fast to rubbing and to washing.

It is normal to use pigments, as opposed to substantive dyes, as the colours in the prints, as the application processes for pigments are very much more straightforward and only require a fixation process after the printing. Substantive dye printing is more suited to printing long runs of fabric before it is made into individual garments.

In pigment printing, the pigment is applied together with a binder, which holds the pigments in place on the fabric. The binder is a clear, film-forming, flexible polymer that coats both the pigments and the fibres. The fixation process serves to allow the binder to spread out and then crosslink. The fixation process is generally a treatment at an elevated temperature for a short time,—e.g. 3 minutes at 150° C. After fixation, the binder is an insoluble film covering the surface of the fibres.

For woven fabrics, such as sheeting, shirting and most dress goods, there is a very limited amount of stretch in the fabric. These fabrics are often printed with pigments. The binders used for this purpose are nearly always based on polymers of acrylic esters or butadiene/acrylic ester copolymers. They give excellent fastness and a soft handle. However they are totally inadequate for printing on fabrics that have a high degree of stretch, such as knitted cotton interlock, as they do not stretch with the fabric and therefore crack when the fabric is stretched.

When the base fabric is very stretchable, as is usual for leisure wear, the printed mark must also be stretchable, or else it will either prevent the fabric from stretching and so greatly impair the aesthetic appeal of the garment, or else it will crack when the fabric is stretched and spoil the visual impact of the design.

It is normal practice to use plastisol inks, i.e. inks which are based on polyvinyl chloride (PVC) emulsions, for this type of application.

For several reasons, however, there is a strong motivation in the industry to get away from compositions containing PVC.

Plastisol inks usually also contain plasticisers. These are present because PVC alone is a very rigid plastic and has to be softened or plasticised to give it the necessary degree of flexibility. The plasticisers are often phthalate esters and may be harmful to the environment. They may be leached out of the print during washing or may evaporate, particularly during drying in garment production processes or in household driers.

The normal plastisol inks also usually contain significant amounts of heavy metals, such as lead or cadmium, as stabilisers for the PVC which are often undesirable. Thus a strong demand exists in industry dealing with printing stretched textile material to find a method for printing such articles without the use of PVC, a plasticiser like e.g. phthalate esters and/or heavy metals.

It has now been found that textile fabrics, especially T-shirts and similar articles can surprisingly be printed using the inventive printing pastes containing a polyurethane emulsion binder, an organic fixing agent and optionally further ingredients.

The invention thus concerns a process for printing textile fabrics characterised in that the fabrics are treated with a printing paste containing a polyurethane, an organic fixing agent, water, optionally a pigment and/or further ingredients.

The printing pastes used in the inventive process are a further part of the invention. They contain:

a) 5 to 30% by weight of a polyurethane,
b) 1 to 20% by weight of an organic fixing agent,
c) 0 to 50% by weight of one or more further ingredient(s) and
d) water as the remainder, the sum of the amounts of components (a)+(b)+(c)+(d) being 100%.

Preferred printing pastes contain:

a) 10 to 25% by weight of a polyurethane,
b) 2 to 15% by weight of an organic fixing agent,
c) 1 to 40% by weight of one or more further ingredients and
d) water as the remainder.

The above % values refer to the pure amounts of urethane, organic fixing agent etc.

The polyurethanes are preferably used as stable aqueous polyurethane dispersions containing only small amounts (less than 3%) or no organic solvent. Such polyurethanes and dispersions consist of a) a diisocyanate component,
b) a diol component,
c) optionally further components and
d) optionally water.

Some of the above urethanes and dispersions are commercially available.

In principle, all the well-known polyurethanes prepared by polyaddition of a di- or polyfunctional isocyanate and a di- or polyfunctional alcohol can be applied in the printing pastes according to the invention.

Preferably the polyurethanes are derived from aliphatic, cycloaliphatic, araliphatic or aromatic diisocyanates. Typical of such diisocyanate compounds are hexamethylene diisocyanate, biuret of hexamethylene diisocyanate, 2,2,4-trimethyl-hexamethylene diisocyanate, 1,4-diisocyanatocyclohexane, 4,4'-diisocyanatodicyclohexylmethane, isophorone diisocyanate, 1,3-cyclohexane bis(methyllsocyanate), 1,4-diisocyanatobenzene, diphenylmethane diisocyanate in the form of its 2,2'-, 2,4'- and 4,4'-isomers, diisocyanatotoluene in the form of its 2,4- and 2,6-isomers and 1,5-diisocyanatonaphthalene.

The most preferred diisocyanates for the preparation of the polyurethanes suitable as component (a) are toluene diisocyanate, isophorone diisocyanate and, in particular, hexamethylene diisocyanate.

Di- or polyfunctional alcohols suitable for the preparation of polyurethanes are hydroxy-terminated polyethers and, in particular, hydroxy-terminated polyesters. Hydroxy-terminated polyesters can be prepared, for example, by the condensation of appropriate proportions of glycols and higher functionality polyols with dicarboxylic or polycarboxylic acids.

Some of the above polyurethanes and dispersions are commercially available.

Preferably, component (a) of the printing pastes according to the invention is an isocyanate-terminated reaction product of polyisocyanates and hydroxy-terminated polyesters, more specifically the polyaddition product of a diisocyanate and a polyester polyol produced by reacting a difunctional acid with an excess of a di- and/or tri-functional alcohol.

As the difunctional acid preferably succinic acid and especially adipic acid are used.

The di- and/or tri-functional alcohol may be an alkane diol or triol having 2 to 6 carbon atoms; these alcohols optionally can contain ether groups and/or can contain diamine components or polyether alcohols. All these compounds are well known in polyurethane chemistry. They are e.g. described in U.S. Pat. No. 5,961,906 in columns 1 and 2.

Preferably, the difunctional alcohol is ethylene glycol, propylene glycol, diethylene glycol, dipropylene glycol, polyethylene glycol or polyproylene glycol.

Preferably organic fixing agents are used which are described in U.S. Pat. No. 6,080,830. The organic fixing agent differs from standard reactive isocyanates used for this purpose in that the molecular structure is not based around a central polymer molecule. Desirably the fixing agent has a multiplicity of isocyanate groups arranged along a relatively small molecule. Generally the molecular weight will be below 10,000 and preferably below 5,000. In some cases the compound can have a molecular weight as low as a few hundred, but usually will be at least 1,000. More preferably the compound has a molecular weight in the range of 2,000 to 5,000, most preferably around 3,000 to 4,000.

The organic fixing agent may contain the aromatic components distributed throughout the molecule. Improved results are obtained when the isocyanate groups or the isocyanate precursor groups are bonded directly to an aromatic moiety. Preferably the compound additionally contains aromatic moieties distributed throughout each molecule of the fixing agent. This may be achieved by reacting an aromatic compound containing at least two functional groups, one of which must be an isocyanate with other multifunctional reaction species to provide a reaction product which contains aromatic species throughout the molecules and also free or isocyanate groups or precursor groups attached directly to an aromatic moiety. It may be desirable to use blocked or partially blocked aromatic isocyanates in preparing the compounds.

Preferably the organic fixing agent is obtainable by the following process steps:

a) reacting a diisocyanate or a mixture of diisocyanates (component I) with one or more alcohols having from 2 to 8 carbon atoms and/or with one or more mono- and/or diethers of such alcohols (component II), these alcohols or ethers thereof having at least two alcoholic hydroxyl groups and no more than two C—O—C bonds, and the reaction being carried out such that the product formed still has free isocyanate groups, b) reacting the product obtained in step a) with an organic amine containing two or more alcoholic hydroxyl groups, or a mixture of such amines, the reaction being carried out such that the product formed still has free isocyanate groups, with the proviso that at least one alcohol, one ether or one amine from amongst the alcohols, ethers and amines used in step a) and/or b) contains three or more alcoholic hydroxyl groups, c) blocking the free isocyanate groups of the product obtained in step b) by reaction with a blocking agent, d) dispersing the product obtained after step c) in water using one or more dispersants and adjusting the pH.

The isocyanate organic fixing agent may be prepared in accordance with the teachings of U.S. Pat. No. 6,080,830.

The diisocyanates used in step a) for preparing the compositions according to the invention are known and described, for example, without laying claim to completeness, in EP-A 537 578. Preference is given to aromatic diisocyanates. Particularly suitable diisocyanates are diphenylmethane diisocyanates of the general formula (III) in particular, diphenylmethane 4,4'-diisocyanate, or toluylene diisocyanates of the general formula (IV) in which case it is possible to use either individual isomers or mixtures of isomeric diphenylmethane or toluylenediisocyanates.

The reaction with the diisocyanates is carried out using step a) alcohols having from 2 to 8 carbon atoms or mono- or diethers of such alcohols or mixtures of these alcohols and their mono- or diethers. The alcohols and the mono- or diethers must have at least two free hydroxyl groups and no more than two C—O—C bonds.

For the preparation of the compositions according to the invention in step a), suitable di- or polyhydric alcohols having from 2 to 8 carbon atoms are known. Aliphatic, either linear or branched, alcohols are suitable and preferred. Dihydric alcohols, for example ethylene glycol, 1,3-propylene glycol, 1,2-propylene glycol, 1,4-butanediol, 1,5-pentanediol, neopentyl glycol and 1,6-hexanediol are highly suitable. Tri- and polyhydric alcohols, for example glycerol, trimethylolpropane and pentaerythritol, are highly suitable. Of the polyhydric alcohols, the trihydric alcohols are preferred. 1,2-propylene glycol and 1,1,1-trimethylolpropane are particularly suitable. Mono- or diethers which can be used in step a) are also known. They consist, for example, of two or three molecules, linked to one another by ether linkages, of di- or polyhydric alcohols and have at least two free hydroxyl groups and no more than two C—O—C bonds (ether alcohols). Monoethers, for example diethylene glycol or dipropylene glycol, and diethers, for example triethylene glycol or tripropylene glycol, are highly suitable. In the reaction with a plurality of components having hydroxyl functions—alcohols and/or ethers—in step a), they can be reacted with the diisocyanate component either as a mixture or else in stages.

Organic amines having two or more alcoholic hydroxyl groups which can be used for the reaction in step b) are known. In the preparation of the compositions according to the invention, preference is given to using secondary or tertiary amines in step b), although it is also possible to use primary amines whose organic radical which is bonded to nitrogen contains at least two alcoholic hydroxyl groups. Examples of highly suitable secondary amines are diethanolamine and dipropanolamine. Tertiary amines of the general formula (A)

$$R_{3-y}N(R'—OH)_y \quad (A)$$

are preferably suitable, in which R is an alkyl radical having from 1 to 18, preferably from 1 to 4, carbon atoms, R' is a linear or branched alkylene radical having from 2 to 4 carbon atoms and y is 2 or 3, including alkoxylated amines, for example N-methyl-, N-dodecyl- or N-stearyldiethanolamine, and also triethanolamine.

For the preparation of the compositions according to the invention, it is important that the reaction products obtained have a certain degree of branching. This is achieved by at least one of the compounds reacted with isocyanate groups in step a) or b) (alcohol, ether, amine) containing at least three alcoholic hydroxyl groups. For example, propylene glycol is used in step a) and triethanolamine in step b), or trimethylolpropane is used in step a) and N-methyldiethanolamine in step b). By varying the reaction conditions, e.g. degree of branching, it is possible to avoid gelation.

Step a) is preferably carried out with quantities of diisocyanates and alcohols and/or ethers such that between 0.1 and 0.5 equivalents of alcoholic hydroxyl groups are used per equivalent of isocyanate groups. When this is the case, step b) is then preferably carried out with quantities of reaction products from step a) and alcoholic hydroxyl group-containing amines such that between 0.05 and 0.5 equivalents of alcoholic hydroxyl groups are used per equivalent of isocyanate groups used in step a). Step a) and step b) are carried out with quantities of diisocyanates, alcohols and/or ethers and amines such that the reaction products obtained after step a) and after step b) still contain free isocyanate groups. The quantities of diisocyanate, alcohol and/or ethers and amine are preferably selected such that the sum of the equivalents of alcoholic hydroxyl groups used in step a) and b) does not exceed 0.7 per equivalent of isocyanate groups used in step a). Particular preference is given to using from 0.3 to 0.5 equivalents per equivalent of isocyanate groups in step a) and, when this is the case, using from 0.05 to 0.3 equivalents of alcoholic hydroxyl groups in step b).

Preference is given to compositions according to the invention in which 1,2-propylene glycol or a mixture of 1,2-propylene glycol and one or more mono- or diethers of 1,2-propylene glycol, each of these ethers having two hydroxyl groups, are used as component II in step a). Particular preference is given to compositions according to the invention in which a diisocyanate or a mixture of diisocyanates in the presence of a reaction product containing free isocyanate groups, which is obtainable by reaction of this diisocyanate or diisocyanate mixture with a dihydric alcohol or with a mixture of such an alcohol and mono- and/or diethers of such an alcohol, is used as component I in step a) for the reaction with component II. Particular preference is also given to compositions according to the invention in which a mixture of a diisocyanate or a reaction product containing free isocyanate groups, which is obtainable by reaction of this diisocyanate with 1,2-propylene glycol or with a mixture of 1,2-propylene glycol and one or more mono- or diethers of 1,2-propylene glycol, is used as component I in step a). Particular preference is also given to compositions according to the invention in which the mixture of diisocyanate and its reaction product has been obtained by reaction of diisocyanate with 1,2-propylene glycol or with a mixture of 1,2-propylene glycol and one or more mono- or diethers of 1,2-propylene glycol in a ratio of one equivalent of isocyanate groups to from 0.1 to 0.3 equivalents of alcoholic hydroxyl groups.

Particular preference is also given to compositions according to the invention in which, in step a), component I is firstly reacted with a tri- or polyhydric alcohol to give a product which still contains free isocyanate groups, and the resulting product is then reacted, in step b), with a compound of the formula (B), $$R''N(CH_2CH_2OH)_2 \quad (B)$$

in which R" is an alkyl group having from 1 to 4 carbon atoms, to give a product which still contains free isocyanate groups.

The blocking agents used to block the remaining free isocyanate groups in step c) are known and described for example, without laying claim to completeness, in EP-A 537 578. Highly suitable blocking agents are ketone oximes, butanone oxime being particularly suitable. Step c) is carried out with quantities of blocking agents and under conditions such that the obtained reaction products essentially no longer have free isocyanate groups.

The reaction according to step a), b) and/or the blocking according to step c) is advantageously carried out in homogeneous liquid phase, preferably in a solvent. Suitable solvents are polar, aprotic, organic solvents, as, for example, described in EP-A 537 578. Examples of highly suitable solvents are esters of organic acids or ethers. Particularly suitable solvents are lower ketones which are virtually insoluble in water, preferably methyl isobutyl ketone. The organic solvents can be removed again from the compositions according to the invention, e.g. by distillation, preferably after an aqueous dispersion which comprises the composition has been prepared.

The reaction according to step a) is advantageously carried out in the presence of a catalyst in order to achieve an appropriate reaction rate. It is possible to use any catalysts which are suitable for the reaction of isocyanate groups with alcoholic hydroxyl groups. Examples of suitable catalysts are tertiary amines, including 1,4-diazabicyclo[2.2.2]-octane. Particularly suitable catalysts are organotin compounds, for example dibutyltin dilaurate, dibutyltin dioctanoate, dioctyltin dilaurate or tin octanoate. For the reaction in step b) or c), the presence of a catalyst is not required, although the catalyst used in the reaction in step a) is advantageously not removed from the product obtained in step a) before the reactions in step b) and c) are carried out.

The reaction in step a) and b) is normally carried out at a temperature of from 0 to 150° C. and the blocking according to step c) at a temperature of from 0 to 100° C. The reaction in step a), b) and c) is preferably carried out at a temperature of from 20 to 90° C., particularly preferably at from 40 to 80° C.

It is advantageous, especially with regard to handling and also the environment, to prepare and use the compositions according to the invention as aqueous dispersions. For this purpose, the reaction product obtained in step c) is dispersed in water. Since the reaction products obtained in step c) normally do not form stable dispersions with water, suitable dispersants are used in concentrations familiar to the person skilled in the art for this purpose. Suitable dispersants are nonionic surfactants, for example alkoxylated fatty alcohols, fatty acids and sorbitan esters and also ethylene oxide-propylene oxide block copolymers and amine oxides. Suitable dispersants are also cationic surfactants, for example tetraalkyl-ammonium salts or ethoxylated alkylamines and salts thereof, and also alkoxylated and quaternized alkylamines. A particularly suitable dispersant in a number of cases is ethoxylated castor oil having, on average, from 10 to 50, particularly preferably from 25 to 40, ethylene oxide units. Suitable dispersants can either be used on their own or also as mixtures of two or more dispersants. Examples of highly suitable dispersants are mixtures of ethoxylated castor oil and alkoxylates of fatty alcohols or of fatty acids. The pH can be adjusted during or after dispersion to the range which is optimum for the stability of the dispersion and for the intended use. The pH of the dispersions is normally adjusted to a value of from 1.5 to 9, preferably from 2.5 to 4. The pH can be adjusted using agents known to the person skilled in the art, for example organic or inorganic acids.

The dispersions are normally prepared in the following way: water, a dispersant or a dispersant mixture and, if desired, further components are homogenized, and the reaction product obtained in step c) and, if desired, the acid used to adjust the pH are finely distributed in this mixture using a mechanical high-speed stirrer. It is also possible to add the acid to the water/dispersant mixture before the reaction product is added. A mixture can be prepared by using water, dispersants, reaction product, acid and other components in any sensible order. The resulting mixture can be converted into a stable, finely divided dispersion using a high-pressure homogenizer at a pressure of from 100 to 500 bar, preferably from 200 to 300 bar. Either mixing or high-pressure homogenization can be carried out at normal or elevated temperature.

At temperatures which are too low, there is the risk of product precipitation from the dispersion, and the maximum temperature is determined by the boiling point of the water/solvent mixture. Step d) is preferably carried out at 20–40° C., the high-pressure homogenization advantageously with cooling. After the dispersion has been obtained, any solvent present is preferably removed, for example by distillation, if desired under reduced pressure. In addition to the advantages of environmental friendliness and an increased flash point, solvent-free dispersions also often have the advantage of increased stability.

Further preferred organic fixing agents which can be employed as component c) are fatty acid esters, in particular fatty acid esters of fatty alcohols, and low molecular weight ($M_w$<10,000) polyesters.

Suitable fatty acid esters are, for example, glyceryl tricaprylate and glyceryl caprate.

Examples for suitable polyesters are 1,3-Butanediol, polymer with hexanedioic acid, bis(2-ethylhexyl)ester and polyesters prepared by reaction of terephthalic acid and one or more polyethylene glycols, the polyethylene glycol(s) having a molecular weight of from about 200 to about 1500.

Such fixing agents can be prepared according to known methods or are commercially available, like for example Priplast® 3157 and Estasan® GT 8-65 3577, both supplied by Uniqema.

Further components which may be present in the printing pastes are e.g. natural or synthetic thickeners, pigments, acids, bases and/or salts to adjust the pH to the desired value, anionic, nonionic or cationic surfactants, antifoaming and antifrosting agents, polyhydroxy compounds and reaction products of hydroxyl compounds and isocyanates. These ingredients are commonly used or recommended for textile printing or finishing.

Suitable polyhydroxy compounds are e.g. ethylene glycol, propylene glycol, tetramethylene glycol, diethylene glycol, dipropylene glycol, polyethylene glycol, polypropylene glycol and polytetrahydrofuran.

In a further preferred embodiment the printing paste according to the invention contains as further component (c) 1 to 15% by weight, preferably 4 to 12% by weight, of ethylene glycol, propylene glycol, diethylene glycol, dipropylene glycol, polyethylene glycol or polyproylene glycol.

For an improved washability of the screen it is recommended to add small amounts (0.01 to 2% by weight, preferably 0.1 to 1.0% by weight, based on the total composition) of a polyester prepared by reaction of terephthalic acid and one or more polyethylene glycols, the polyethylene glycol(s) having a molecular weight of from about 200 to about 1500, to the printing paste.

The printing paste according to the invention preferably does not contain polyvinyl chloride or alkyl phthalates or heavy metals.

The printing paste can be applied in conventional manner using conventional equipment. Preferably, however, a multistage process is used to obtain perfect adhesion and/or to obtain special effects. In the first step a base coat, containing the ingredients of the inventive printing paste, but no pigment, is applied to the textile material, which is then cured e.g. by heating. Afterwards the overprint is applied and the textile material is finished in the conventional way.

It is also possible to add pigment to the base coat, e.g. if a coloured top layer should be applied to a white or monochromatic background.

The prints obtained according to the invention are excellent. They are fast to washing and rubbing and are as flexible as prints made with plastisols.

The advantages are that PVC is eliminated from the printing system, there are no plasticisers or heavy metal stabilisers. At the end of its life the garment can be recycled safely and used e.g. in paper or other textile processes, or incinerated or dumped in landfill. The instantly used printing pastes containing polyurethane and organic fixing agent exhibit the following advantages:

- Improvement in surface handle by the inclusion of up to 50 g/kg of various softeners e.g. amino silicone, PDMS oils etc.
- Use of clear coat with pigment to print on white fabric with outstanding wash fastness
- Possibility of using low temperature cure compared with regular (PVC containing) system.
- Possibility of using no or at least minor amounts of ammonia.

Accordingly, a further object of the invention is a method for printing textile material comprising the steps of applying at least one coat containing a printing paste according to the invention and optionally a pigment and curing the coat.

Preferably, the method for printing textile material comprises the steps of applying at least one base coat containing a printing paste according to the invention and optionally a pigment, curing the base coat, applying at least one overprint coat containing a printing paste according to the invention and a pigment, curing the overprint coat and finishing the textile material.

The inventive printing pastes are especially useful for printing textile material made of natural or synthetic polyamide, like nylon, perlon, silk or wool, viscose rayon or most preferably cotton.

The following non-limitative Examples illustrate the invention in more detail. Parts and percentages are by weight, unless otherwise stated.

EXAMPLE 1

Standard 100% cotton interlock knitted T-shirts were printed on a carousel printing machine. The T-shirts were dyed to an orange shade.

A clear base was applied at the first station:

Clear Base Recipe:

- 300 g/kg of a commercial polyurethane emulsion, sold for textile coating applications consisting of 50% urethane resin, 49.2% water and 0.8% organic solvent, The polyurethane is the the polyaddition product of hexamethylenediisocyanate and a hydroxy-terminated polyester prepared from adipic acid and polyethylene glycol
- 60 g/kg of an organic fixing agent agent which was made up according to Example 1 of U.S. Pat. No. 6,080,830. This was a 40 weight-% active content emulsion of a branched aromatic polyurethane with terminal isocyanate groups blocked with butanone oxime.
- 5 g/kg of 30% ammonia solution
- 627 g/kg of water
- 8 g/kg of a dispersion of a crosslinked poly(ammonium acrylate) commonly used as a thickener in pigment printing.

Make up of base coat:

The water was measured into a 5 litre beaker and stirred gently.

The polyurethane emulsion was weighed in.

The pH was adjusted to 8–9 by adding the ammonia.

The organic fixing agent was added and stirred in.

The thickener was added and the stirrer speed increased and maintained for 10 minutes until the mixture was homogenous and viscous.

The viscosity was measured with a Brookfield RVT rotary viscometer at 10 rpm, spindle #6. The viscosity was 25000 cP.

The base coat was flash cured.

Then at a subsequent station an overprint was applied.

Overprint Recipe:

350 g/kg of the polyurethane emulsion used for the clear base recipe, 350 g/kg of titanium dioxide, 60 g/kg of polyethylene glycol 400, 12 g/kg of a non-ionic surfactant 5 g/kg of a 40% aqueous solution of a low molecular weight poly(sodium acrylate) in water 60 g/kg of an organic fixing agent agent which was made up according to Example 1 of U.S. Pat. No. 6,080,830. This was a 40 weight-% active content emulsion of a branched aromatic polyurethane with terminal isocyanate groups blocked with butanone oxime.

3 g/kg of an acrylic polymer dispersion, 30 g/kg of a commercial Navy pigment used for pigment printing, up to 1000 water.

The above combination was printed onto a dark blue knitted cotton fabric. It gave a bright blue print with washing fastness of 3 on the SDC grey scale.

Compared with the normal plastisol printed items, the T-shirts printed by the above process have superior stretch and washing fastness. The opacity and definition are equal or superior to those of prints made with a normal plastisol recipe.

What is claimed is:

1. A printing paste containing:

a) 5 to 30% by weight of a polyurethane, b) 1 to 20% by weight of an organic fixing agent which is a fatty acid ester, a low molecular weight polyester or a compound obtained by the following process steps:

A) reacting a diisocyanate or a mixture of diisocyanates (component I) with one or more alcohols having from 2 to 8 carbon atoms and/or with one or more mono- and/or diethers of such alcohols (component II), these alcohols or ethers thereof having at least two alcoholic hydroxyl groups and no more than two C—O—C bonds, and the reaction being carried out such that the product formed still has free isocyanate groups, B) reacting the product obtained in step A) with an organic amine containing two or more alcoholic hydroxyl groups, or a mixture of such amines, the reaction being carried out such that the product formed still has free isocyanate groups, with the proviso that at least one alcohol, one ether or one amine from amongst the alcohols, ethers and amines used in step A) and/or B) contains three or more alcoholic hydroxyl groups, C) blocking the free isocyanate groups of the product obtained in step B) by reaction with a blocking agent, D) dispersing the product obtained after step C) in water using one or more dispersants and adjusting the pH, c) 0 to 50% by weight of one or more further ingredient(s) and d) water as the remainder, the sum of the amounts of components (a)+(b)+(c)+(d) being 100%.

2. A printing paste according to claim 1 containing:

10 to 25% by weight of a polyurethane, 2 to 15% by weight of an organic fixing agent, 1 to 40% by weight of one or more further ingredient(s) and water as the remainder.

3. A printing paste according to claim 1, wherein the urethane is used as a stable aqueous polyurethane dispersion containing less than 3% or no organic solvent.

4. A printing paste according claim 1, wherein the polyurethane used is the polyaddition product of a diisocyanate and a polyester polyol produced by reacting a difunctional acid with an excess of a di- and/or tri-functional alcohol.

5. A printing paste according to claim 4, wherein the polyurethane used is the polyaddition product of a diisocyanate and a polyester polyol produced by reacting succinic acid or adipic acid with an excess of a di- and/or tri-functional alcohol.

6. A printing paste according to claim 4, wherein the polyurethane used is the polyaddition product of a diisocyanate and a polyester polyol produced by reacting a difunctional acid with an excess of ethylene glycol, propylene glycol, diethylene glycol, dipropylene glycol, polyethylene glycol or polypropylene glycol.

7. A printing paste according to claim 4, wherein the polyurethane used is the polyaddition product of hexamethylene diisocyanate, toluene diisocyanate or isophorone diisocyanate and a polyester polyol produced by reacting a difunctional acid with an excess of a di- and/or tri-functional alcohol.

8. A printing paste according to claim 1, wherein the organic fixing agent b) is a fatty acid ester.

9. A printing paste according to claim 1, wherein the organic fixing agent b) is a low molecular weight polyester.

10. A printing paste according to claim 1, wherein as further ingredient(s), one or more natural or synthetic thickeners, pigments, acids, bases and/or salts to adjust the pH to the desired value, anionic, nonionic or cationic surfactants, antifoaming agents, antifrosting agents, polyhydroxy compounds or reaction products of hydroxyl compounds and isocyanates are used.

11. A printing paste according to claim 1, containing as further component (c) 1 to 15% by weight of ethylene glycol, propylene glycol, diethylene glycol, dipropylene glycol, polyethylene glycol or polypropylene glycol.

12. A printing paste according to claim 1, containing no polyvinyl chloride or alkyl phthalates or heavy metals.

13. Any fabric or garment printed with a printing paste according to claim 1.

14. A method for printing textile material comprising the steps of applying at least one coat containing a printing paste according to claim 1 and optionally a pigment and curing the coat.

15. A method for printing textile material comprising the steps of applying at least one base coat containing a printing paste according to claim 1 and optionally a pigment, curing the base coat, applying at least one overprint coat containing a printing paste according to claim 1 and a pigment, curing the overprint coat and finishing the textile material.

* * * * *

UNITED STATES PATENT AND TRADEMARK OFFICE

CERTIFICATE OF CORRECTION

PATENT NO. : 7,022,761 B2
APPLICATION NO. : 10/481348
DATED : April 4, 2006
INVENTOR(S) : Alan John Crabtree et al.

It is certified that error appears in the above-identified patent and that said Letters Patent is hereby corrected as shown below:

On title page, Item (54) should read:

-- (54) PRINTING PASTE AND PROCESS FOR PRINTING TEXTILE FABRICS --.

Signed and Sealed this

Eighth Day of August, 2006

JON W. DUDAS
*Director of the United States Patent and Trademark Office*